US005531038A

United States Patent [19]

Keith

[11] Patent Number: 5,531,038

[45] Date of Patent: Jul. 2, 1996

[54] CORNER MOUNTABLE DISPLAY DEVICE FOR GREETING CARDS

[76] Inventor: Kevin C. Keith, 12008 W. 87th St., #183, Lenexa, Kans. 66215

[21] Appl. No.: 395,908

[22] Filed: Feb. 28, 1995

[51] Int. Cl.[6] ..... G09F 1/00

[52] U.S. Cl. ..... 40/124.1; 40/600; 40/594; 248/205.3; 248/206.5

[58] Field of Search ..... 40/124.1, 152.1, 40/539, 594, 600, 621; 248/205.3, 205.4, 206.5, 683

[56] References Cited

U.S. PATENT DOCUMENTS

| | | | |
|---|---|---|---|
| 2,557,399 | 6/1951 | Teetor | 40/621 X |
| 3,095,668 | 7/1963 | Dorsett | 40/621 X |
| 3,514,731 | 5/1970 | Drake | 248/206.5 X |
| 4,287,676 | 9/1981 | Weinhaus | 40/600 X |
| 4,960,258 | 10/1990 | Stocker | 40/600 X |
| 5,039,047 | 8/1991 | Pitzo | 248/206.5 |
| 5,435,085 | 7/1995 | Johnson | 40/124.1 |

*Primary Examiner*—Brian K. Green

[57] ABSTRACT

A corner mountable display device for greeting cards comprising: a shell having at least two generally linear side faces which meet to form a corner, at least one corner including coupling devices affixed thereto, a corner including coupling devices adapted to be positioned within the corner of a greeting card, the shell supporting the card in a generally vertical orientation.

2 Claims, 4 Drawing Sheets

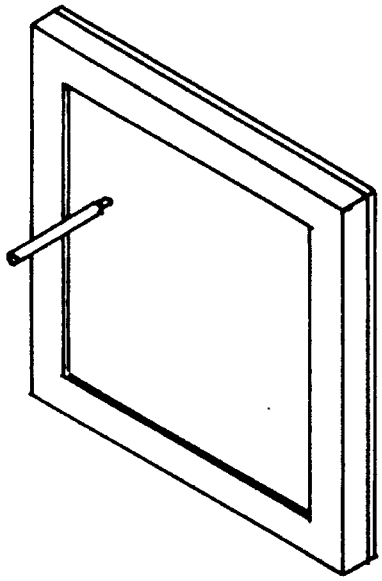
FIG 1
PRIOR ART
FIG 2
PRIOR ART
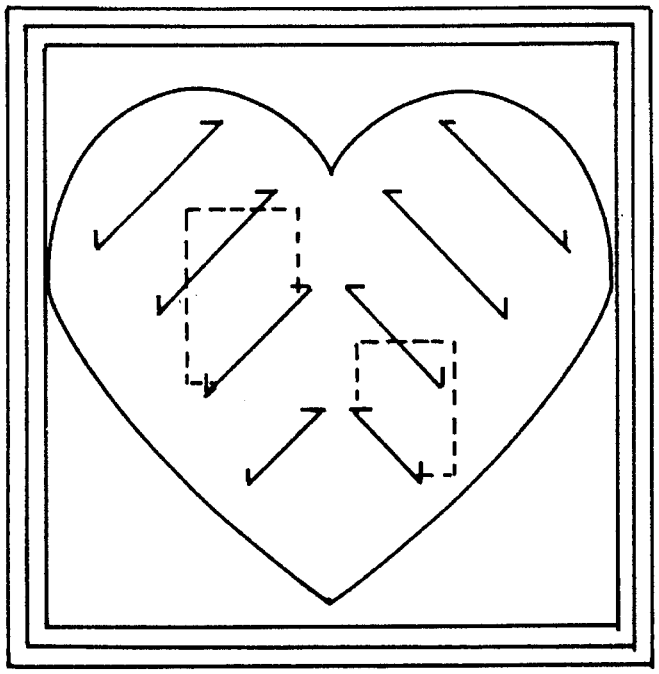

FIG 5
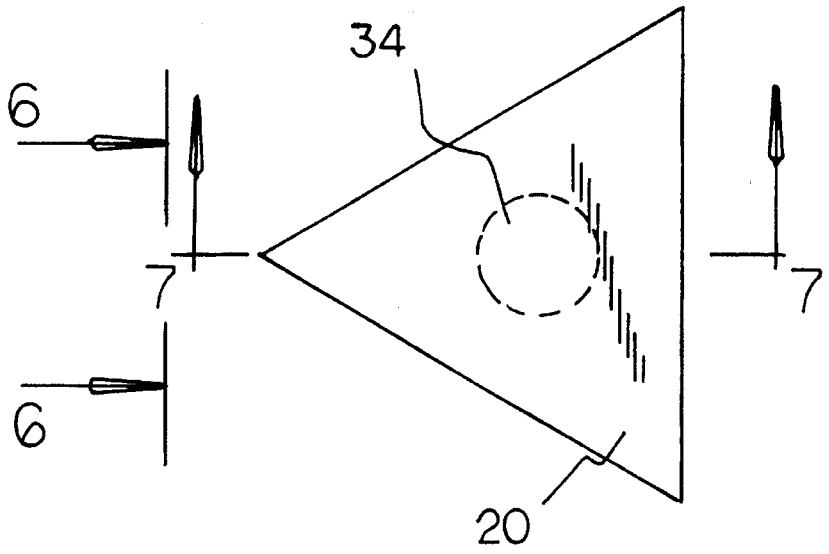
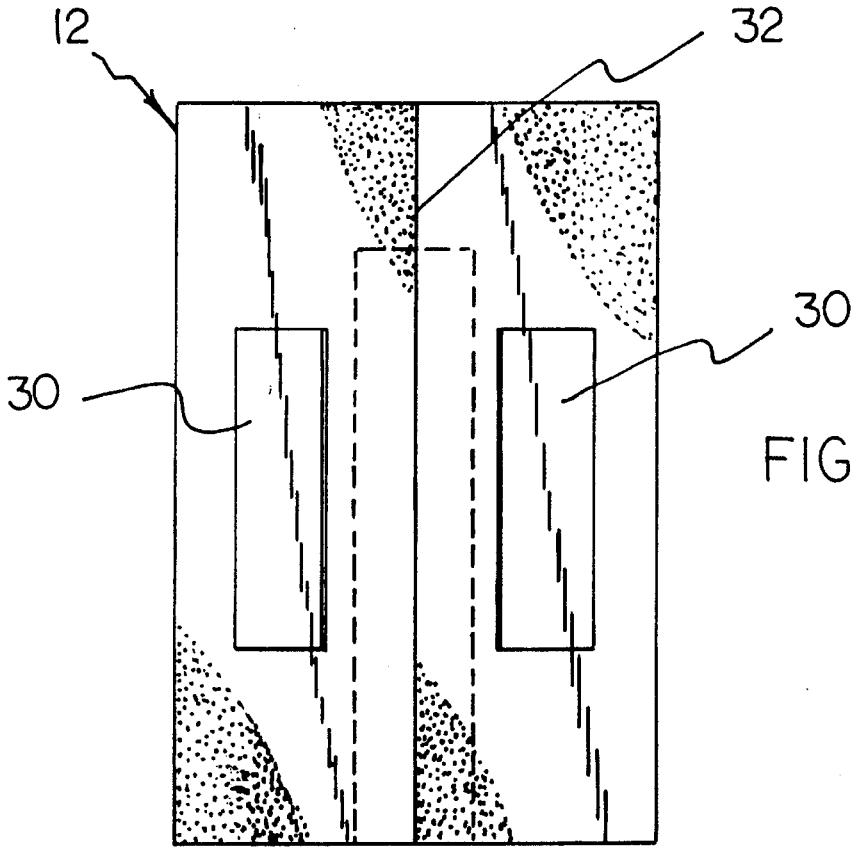
FIG 6

FIG 7
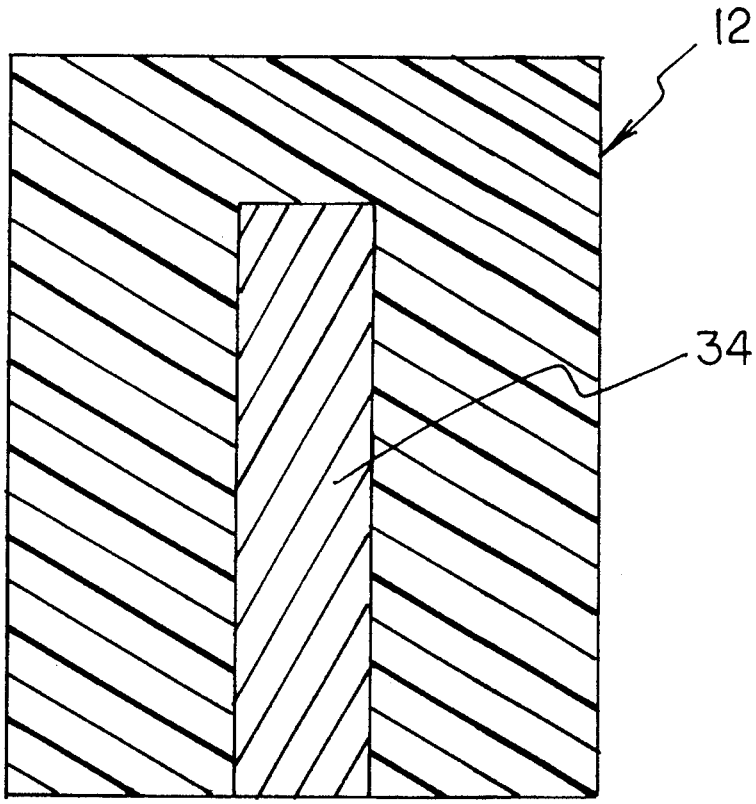
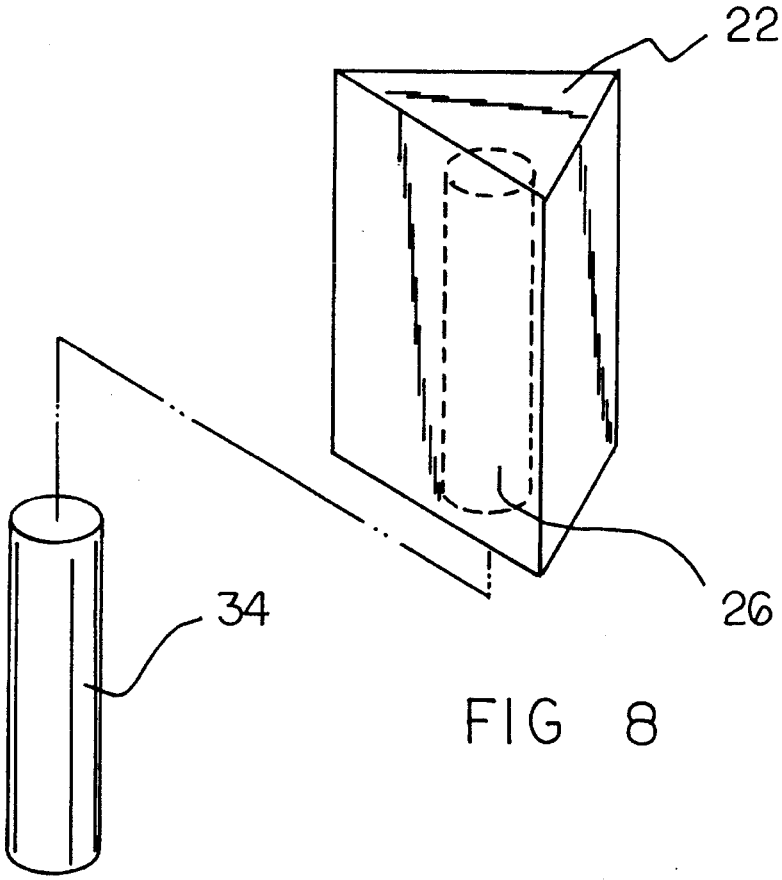
FIG 8

CORNER MOUNTABLE DISPLAY DEVICE FOR GREETING CARDS

BACKGROUND OF THE INVENTION

1. Field of the Invention

The present invention relates to a corner mountable display device for greeting cards and more particularly pertains to displaying greeting cards in an open and stable orientation by fixing the apparatus within the interior corner of a card.

2. Description of the Prior Art

The use of card display devices is known in the prior art. More specifically, card display devices heretofore devised and utilized for the purpose of displaying various types of cards in a plurality of orientations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,609,173 to Belokin a magnetically attachable towel hanger.

U.S. Pat. No. 4,288,936 to Okutsu discloses a wall-hanging type magnetic displaying device.

U.S. Pat. No. 4,138,172 to Hansen discloses a hanging card storage system.

U.S. Pat. No. 4,531,319 to Saxton discloses a hanging mobile greeting card.

U.S. Pat. No. 5,242,062 to Engravalle discloses a display for greeting cards.

Lastly, U.S. Pat. No. 5,272,826 to Gingras discloses a magnetic display card holder.

In this respect, the corner mountable display device for greeting cards according to the present invention substantially departs from the conventional concepts and designs of the prior art, and in doing so provides an apparatus primarily developed for the purpose of displaying greeting cards in an open and stable orientation by affixing the apparatus within the corner of a card.

Therefore, it can be appreciated that there exists a continuing need for a new and improved corner mountable display device for greeting cards which can be used for displaying greeting cards in an open and stable orientation by affixing the apparatus within the interior corner of a card. In this regard, the present invention substantially fulfills this need.

SUMMARY OF THE INVENTION

In view of the foregoing disadvantages inherent in the known types of card display devices now present in the prior art, the present invention provides an improved corner mountable display device for greeting cards. As such, the general purpose of the present invention, which will be described subsequently in greater detail, is to provide a new and improved corner mountable display device for greeting cards and method which has all the advantages of the prior art and none of the disadvantages.

To attain this, the present invention essentially comprises a new and improved corner mountable display device for greeting cards comprising, in combination: a shell fabricated of hard solid plastic, the shell being formed as a pentahedron with five faces and a plurality of corners, the shell including three equally sized outer faces and two triangular end faces, the shell being formed as an equilateral triangle when viewed in cross section, a generally cylindrical shaped bore extending longitudinally within the shell at the approximate center point of an end face, two contiguous outer faces of the shell including peel and stick adhesive coupling means, a corner being positioned between the coupling means and adapted to be positioned within the corner of a greeting card in the operative orientation, the shell supporting a card in a generally vertical orientation; a magnet formed in a solid generally cylindrical configuration, the magnet adapted to be affixed within the bore of the shell, the magnet permitting users to magnetically anchor the apparatus to a metal surface, the magnet serving as a counterweight on non-metallic surfaces; and a plurality of greeting cards having an inner surface and an outer surface, each card being folded over into a generally V-shaped configuration, the inner surface of the V receiving the coupling means of the shell, the cards being secured in an open and upright position when having a shell coupled therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner mountable display device for greeting cards which has all of the advantages of the prior art card display devices and none of the disadvantages.

It is another object of the present invention to provide a new and improved corner mountable display device for greeting cards which may be easily and efficiently manufactured and marketed.

It is further object of the present invention to provide a new and improved corner mountable display device for greeting cards which is of durable and reliable constructions.

An even further object of the present invention is to provide a new and improved corner mountable display device for greeting cards which is susceptible of a low cost of manufacture with regard to both materials and labor, and which accordingly is then susceptible of low prices of sale to the consuming public, thereby making such corner mountable display device for greeting cards economically available to the buying public.

Still yet another object of the present invention is to provide a new and improved corner mountable display device for greeting cards which provides in the apparatuses and methods of the prior art some of the advantages thereof, while simultaneously overcoming some of the disadvantages normally associated therewith.

Still another object of the present invention is to display greeting cards in an open and stable orientation by affixing the apparatus within the interior corner of a card.

Lastly, it is an object of the present invention to provide a new and improved a corner mountable display device for greeting cards comprising: a shell being formed as solid object having at least two generally linear side faces which meet to form a corner, at least one corner including coupling devices affixed thereto, a corner including coupling devices adapted to be positioned within the corner of a greeting card, the shell supporting the card in a generally vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein: FIGS. 1 and 2 are respective illustrations of prior art card display devices. FIG. 5 is a top plan view of the apparatus shown in FIG. 4. FIG. 6 is a perspective view of the apparatus taken along line 6—6 of FIG. 5. FIG. 7 is a cross sectional view of the apparatus taken along line 7—7 of FIG. 5. FIG. 8 is a separated perspective view of the apparatus illustrating the positioning of the cylindrical magnet within the bore of the shell.

The same reference numerals refer to the same parts through the various FIGS.

DESCRIPTION OF THE PREFERRED EMBODIMENT

Figure 3:
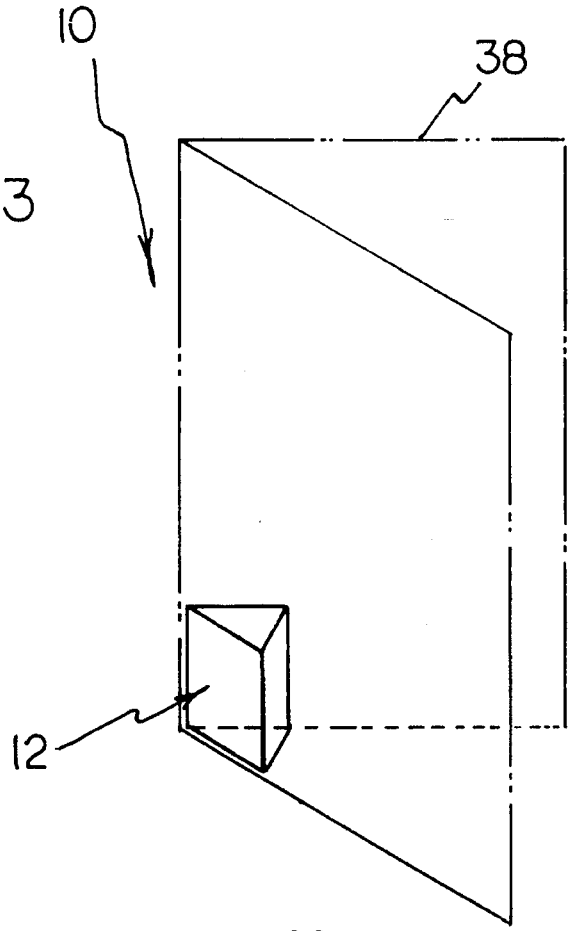
FIG. 3 is a perspective view of the preferred embodiment of the corner mountable display device for greeting cards constructed in accordance with the principles of the present invention.

With reference now to the drawings, and in particular to FIG. 1 thereof, the preferred embodiment of the new and improved corner mountable display device for greeting cards embodying the principles and concepts of the present invention and generally designated by the reference numeral 10 will be described.

The present invention, the corner mountable display device for greeting cards 10 is comprised of a plurality of components. Such components in their broadest context include a shell 12, a magnet and a plurality of greeting cards. Such components are individually configured and correlated with respect to each other so as to attain the desired objective.

Figure 4:
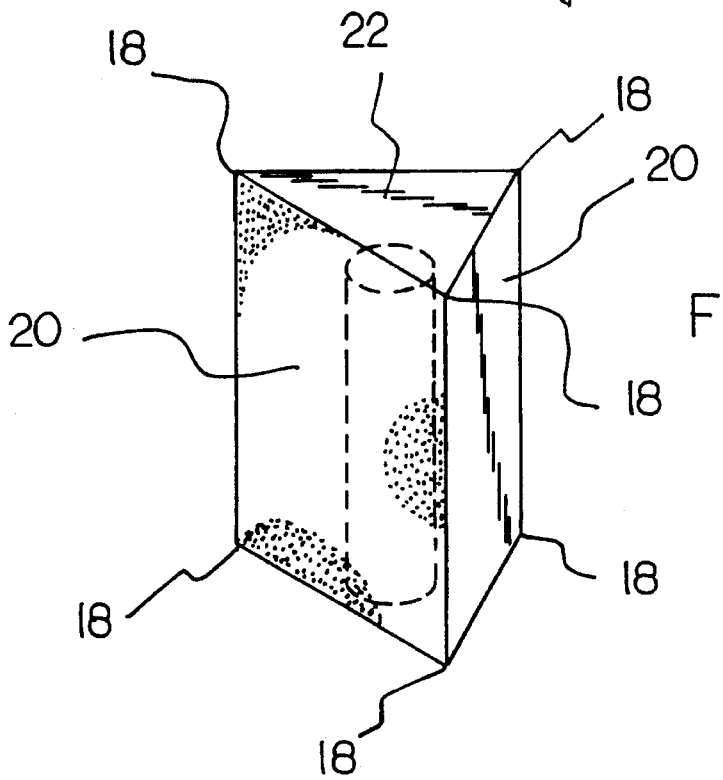
FIG. 4 is an isolated perspective view of the apparatus shown in FIG. 3.

More specifically, the shell 12 is fabricated of hard solid plastic. The sturdy plastic material is resistent to breakage and cracking. The apparatus may be fabricated in a plurality of different colors. The shell is formed as a pentahedron with five faces and a plurality of corners 18. In alternative embodiments of the apparatus the shell is formed in a variety of different configurations. The shell includes three equally sized outer faces 20 and two triangular end faces 22. The shell is formed as an equilateral triangle when viewed in cross section. The three outer faces are about one-half inch wide. The distance between the end faces is about five eighths of an inch. Note FIGS. 4 and 6.

A generally cylindrical shaped bore 26 extends longitudinally within the shell at the approximate center point of a first end face of the shell. The first end face represents the bottom of the apparatus. Two contiguous outer faces of the shell including peel and stick adhesive coupling means 30. A corner 32 is positioned between the coupling means 30 and is adapted to be positioned within the interior corner of a greeting card in the operative orientation. The user simply exposes the adhesive and presses the corner 32 into the bend in the card. Note FIGS. 3 and 6.

In an alternative embodiment of the apparatus velcro strips are used to couple the shell within the corner of a card. The long portion of the apparatus is positioned vertically when placing it within a card. The apparatus supports cards in an open and upright, generally vertical orientation. The apparatus may also be coupled within the upper bend of bottom opening card. The adhesive material is strong enough to support the weight of the apparatus. The apparatus may be removed from the card without causing damage to it. Note FIG. 3.

A magnet 34 is formed in a solid generally cylindrical configuration. The magnet 34 is adapted to be affixed within the bore 26 of the shell. The magnet may be glued within the shell or welded with plastic materials. The magnet permits users to magnetically anchor the apparatus to a metal surface. The magnet prevents the apparatus from falling over even when strong winds or fans are present. The magnet serves as a counterweight on non-metallic surfaces. The additional weight adds stability to the apparatus. The apparatus prevents a domino effect of falling cards when a small breeze knocks one card over. Note FIGS. 5, 7 and 8.

A plurality of greeting cards 38 have an inner surface and an outer surface. Each card is folded over into a generally V-shaped configuration. The inner surface of the V receives the coupling means of the shell. The cards are secured in an open and upright position when a shell is coupled within them. The apparatus may be reused by adding a small amount of glue to the adhesive area when affixing the shell within a greeting card. Note FIG. 3.

The corner mountable display device for greeting cards is a removable device that can be attached to the inside of a greeting card to keep it in an open and upright position without tipping over. The device is a prism-shaped plastic shell. It has three sides which are all ½" wide. The apparatus stands ⅝" tall. A magnet is affixed within the device to anchor it to metallic surfaces. The magnet also provides some additional weight for holding the card in place. It can also be used to display top-folded cards on a vertical metallic surface. Removable adhesive stickers are placed on two adjacent sides of the device to attach it to the inside of the greeting card.

To utilize the apparatus the user places the device base side down inside the fold of the lower portion of a card. The user then presses firmly on the outside of the fold of the card to make the card stick to the adhesive on the sides of the shell. The card can be placed upright on a flat surface where it will remain standing and slightly open. The apparatus can be easily removed without damaging the card.

Most individuals like to display greeting cards received for birthdays and Christmas at home and at work. Usually people will display the cards loosely on cubicles, desks, and coffee tables. Some of the surfaces are metal, some are wood and some are formed of other materials. Anyone who has tried to display greeting cards understands the problems created when a breeze blows them over, or when they all tip over like dominos. This device is perfect for desks, mantles, or coffee tables. It uses less space than a greeting card rack. The device can be removed without ruining the cards. It is reusable, disposable, and can also be used with cards that open from the bottom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved corner mountable display device for greeting cards comprising, in combination:

a shell fabricated of hard solid plastic, the shell being formed as a pentahedron with five faces and a plurality of corners, the shell including three equally sized outer faces and two triangular end faces, the shell being formed as an equilateral triangle when viewed in cross section, a generally cylindrical shaped bore extending longitudinally within the shell at an approximate center point of an end face, two contiguous outer faces of the shell including peel and stick adhesive coupling means, a corner being positioned between the coupling means and adapted to be positioned within a corner of a greeting card in an operative orientation, the shell capable of supporting a greeting card in a generally vertical orientation;

a magnet formed in a solid generally cylindrical configuration, the magnet adapted to be affixed within the bore of the shell, the magnet permitting users to magnetically anchor the device to a metal surface, the magnet serving as a counterweight on non-metallic surfaces; and a plurality of greeting cards having an inner surface and an outer surface, each card being folded over into a generally V-shaped configuration, the inner surface of one of the greeting cards having a V receiving the coupling means of the shell, the greeting cards being secured in an open and upright position when having a shell coupled therein.

2. A corner mountable display device for greeting cards comprising:

a shell being formed as an essentially solid object with a cylindrical bore and a cylindrical magnet within the bore, the shell having at least two generally linear side faces which meet to form a corner, at least one corner including coupling devices affixed thereto, one positioned within a corner of a greeting card, the shell capable of supporting a greeting card in a generally vertical orientation;

a plurality of greeting cards having an inner surface and an outer surface, each card being folded over into a generally V-shaped configuration, the inner surface of one of the greeting cards having a V receiving the coupling devices of the shell, the greeting cards being secured in an open end upright position when having a shell coupled therein.

* * * * *